US005501584A

United States Patent [19]

Yamamoto et al.

[11] Patent Number: 5,501,584

[45] Date of Patent: Mar. 26, 1996

[54] SCROLL TYPE COMPRESSOR HAVING A PASSAGE FROM THE SUCTION CHAMBER TO A COMPRESSION POCKET

[75] Inventors: Shinya Yamamoto; Kiyohiro Yamada; Tetsuhiko Fukanuma; Yasushi Watanabe; Shigeru Hisanaga, all of Kariya; Eiichi Nagasaku, Aichi; Shigeki Iwanami, Okazaki, all of Japan

[73] Assignees: Kabushiki Kaisha Toyoda Jidoshokki Seisakusho; Nippondenso Co., Ltd., both of Kariya, Japan

[21] Appl. No.: 323,537

[22] Filed: Oct. 14, 1994

[30] Foreign Application Priority Data

Oct. 15, 1993 [JP] Japan ..... 5-258692

[51] Int. Cl.[6] ..... F04C 18/04

[52] U.S. Cl. ..... 418/15; 418/55.1; 418/55.2

[58] Field of Search ..... 418/15, 55.1, 55.2

[56] References Cited

FOREIGN PATENT DOCUMENTS

| | | | |
|---|---|---|---|
| 3142439 | 6/1982 | Germany . | |
| 4305044 | 8/1993 | Germany . | |
| 58-067986 | 4/1983 | Japan . | |
| 58-172405 | 10/1983 | Japan . | |
| 60-145474 | 7/1985 | Japan | 418/55.2 |
| 60-222580 | 11/1985 | Japan | 418/55.2 |
| 61-038189 | 2/1986 | Japan . | |
| 61-197786 | 9/1986 | Japan | 418/55.2 |
| 2-27182 | 1/1990 | Japan | 418/55.2 |
| 2308990 | 12/1990 | Japan . | |
| 3134287 | 6/1991 | Japan . | |
| 5-1882 | 1/1993 | Japan . | |

*Primary Examiner*—John J. Vrablik

*Attorney, Agent, or Firm*—Brooks Haidt Haffner & Delahunty

[57] ABSTRACT

A scroll type compressor comprises a fixed scroll having an end plate and a spiral element. The spiral element of the fixed scroll is integrally coupled to the inner wall of a housing. A movable scroll has an end plate and a spiral element, and faces the fixed scroll, with a plurality of fluid pockets formed between the movable scroll and the fixed scroll. When the movable scroll makes an orbital movement around the axis of the rotary shaft, refrigerant gas is led into the fluid pockets from outside the movable scroll. As the fluid pockets move toward the center of the movable scroll the fluid pockets decrease in volume, thereby compressing the refrigerant gas. A suction chamber which receives the refrigerant gas from outside the housing is formed between the movable scroll and the inner wall of the housing. A passage is formed in at least one of the inner wall of the housing, the connecting section and the end plate of the movable scroll. This passage permits the refrigerant gas to flow into the fluid pockets from the suction chamber in order to reduce any difference in pressure of the refrigerant gas in the suction chamber and in the fluid pocket.

10 Claims, 11 Drawing Sheets

SCROLL TYPE COMPRESSOR HAVING A PASSAGE FROM THE SUCTION CHAMBER TO A COMPRESSION POCKET

BACKGROUND OF THE INVENTION

1. Field of the Invention

The present invention generally relates to a scroll type compressor and in particular to a scroll type compressor used in an air conditioning system of a vehicle.

2. Description of the Related Art

Typical components of a conventional scroll type compressor include a fixed scroll formed with a spiral element provided on the surface of a fixed end plate and a movable scroll formed with a spiral element provided on the surface of a movable end plate. Both spiral elements are interfit and disposed in a housing such that one spiral element's side wall contacts various portions of the other spiral element's side wall. As a result, fluid pockets form between the two spiral elements. A suction chamber, defined between the interfit spiral elements and the inner wall of the housing, supplies refrigerant gas to the fluid pockets when the movable scroll rotates. As the fluid pockets move toward the center of the spiral elements, the volumes of the fluid pockets decrease, and in that way, the scroll elements compress the refrigerant gas. The compressed refrigerant gas is then discharged into a discharge chamber located in the aforementioned housing via a discharge port formed in the center portion of the fixed scroll's end plate.

To reduce the weight of these scroll type compressors, the fixed scroll can be made from a light weight metal, such as aluminum or from an aluminum-nickel alloy. The compressor's housing can likewise be made from a light weight metal in order to achieve weight reduction. Japanese Unexamined Patent Publication No. 61-38189 discloses such a housing and fixed scroll formed as separate components. Even further reduction in weight can be accomplished by decreasing the overall size of the compressor, as well as by integrating the housing and fixed scroll into a single component, as disclosed, for example, in Japanese Unexamined Patent Publication No. 3-134287 and Japanese Unexamined Utility Model Publication No. 5-1882.

Scroll type compressors, having separately formed housing and fixed scroll components, enjoy a high degree of design freedom, by being able to use a large cross-sectional area for the refrigerant gas to pass from the suction chamber to the fluid pockets. This helps to assure proper displacement of refrigerant gas from the suction chamber into the fluid pockets.

In order to enhance the strength of the fixed spiral element, in the case where the fixed scroll is integrally formed with the housing, the outer tip portion of the fixed spiral element can be made thicker, relative to other portions, with the thick portion integrally coupled to the inner peripheral surface of the housing. More specifically, as shown in FIG. 13, the outer tip portion of a fixed spiral element 1*b*, formed integrally with a cylindrical housing 1*d*, is continuous along the inner wall of the housing 1*d*, forming a connecting section 1*e*. A movable scroll 9, which engages the fixed spiral element 1*b* and the connecting section 1*e*, has a disk-like end plate 9*a* and a spiral element 9*b* formed integrally with the end plate 9*a*. When the end plate 9*a* slides in contact with a sealing surface S1, between the fixed spiral element 1*b* and the connecting section 1*e*, fluid pockets P between both spiral elements 1*b* and 9*b* are effectively sealed.

During the revolution of movable scroll 9, when the outer tip portion, 9*e*, of the movable spiral element 9*b*, comes closest to the inner peripheral surface, S3, the outer peripheral portion of the end plate 9*a*, indicated in FIG. 13 by long and dashed lines also comes closest the inner peripheral surface S3. Consequently, fluid communication occurring at the beginning of the suction stroke from the suction chamber 12 to a fluid pocket Ps is for the most part blocked. The blockage creates a pressure differential between the space 12 and the fluid pocket Ps on opposite sides of the movable spiral element 9*b*. The action of this differential pressure produces a counter-force to the smooth orbital movement of the movable scroll 9. This counter-force tends not only to impair the smooth orbital movement of the movable scroll 9, but also to degrade the sealing contact of the fluid pocket Ps with the scroll elements and the end plates. The net result of the aforementioned blockage is to produce an increase in wear on the sliding portions of both spiral elements and, consequently, to decrease the compression efficiency of the scroll type compressor.

SUMMARY OF THE INVENTION

It is therefore an objective of the present invention to provide a scroll type compressor which permits the smooth flow of a fluid from a suction chamber to fluid pockets in order to reduce the pressure differential created therebetween when refrigerant gas flows from the suction chamber to the fluid pockets, thus improving the compression efficiency and durability of the compressor.

To achieve the foregoing and other objects and in accordance with the purpose of the present invention, there is provided an improved scroll type compressor. This scroll type compressor comprises a fixed scroll having an end plate and a spiral element. The spiral element of the fixed scroll is integrally coupled to the inner wall of a housing. A movable scroll has an end plate and a spiral element, and faces the fixed scroll, with a plurality of fluid pockets formed between the movable scroll and the fixed scroll. During the orbital movement of the movable scroll around the axis of the rotary shaft, the movable scroll's rotation around its own axis is restricted. Refrigerant gas is at that time supplied to the fluid pockets from a suction chamber formed between the movable scroll and the inner wall of the housing. As each fluid pocket moves toward the center of the movable scroll its volume is effectively reduced, compressing the refrigerant gas. A passage is formed in at least one of the inner walls of the housing, the connecting section and the end plate of the movable scroll. This passage permits the flow of refrigerant gas into the fluid pockets from the suction chamber in a way that reduces any existing difference in pressure between the suction chamber and the fluid pockets.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
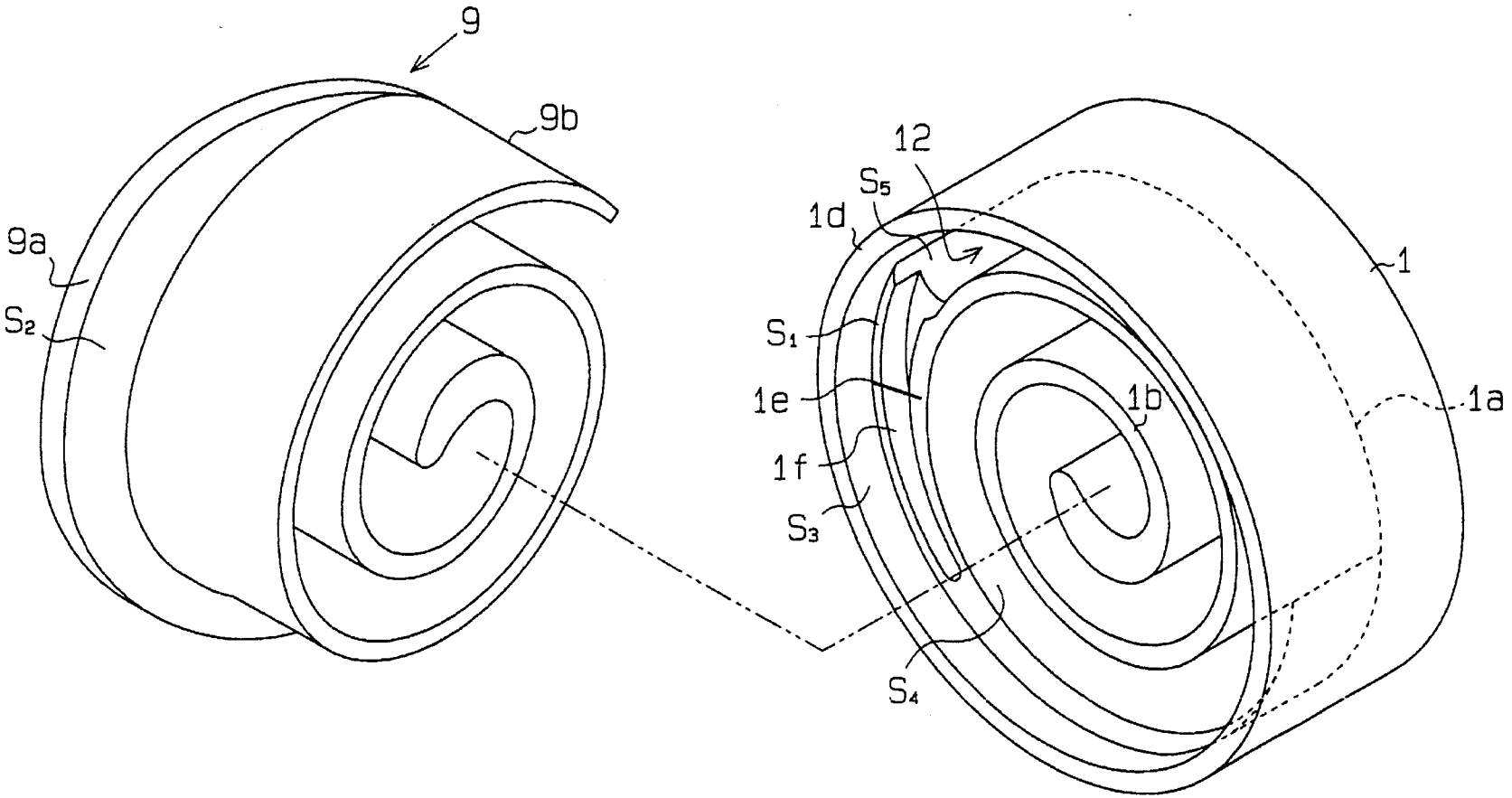
FIG. 1 is an exploded perspective view showing the fixed and movable scrolls of a scroll type compressor which embodies the present invention.
Figure 2:
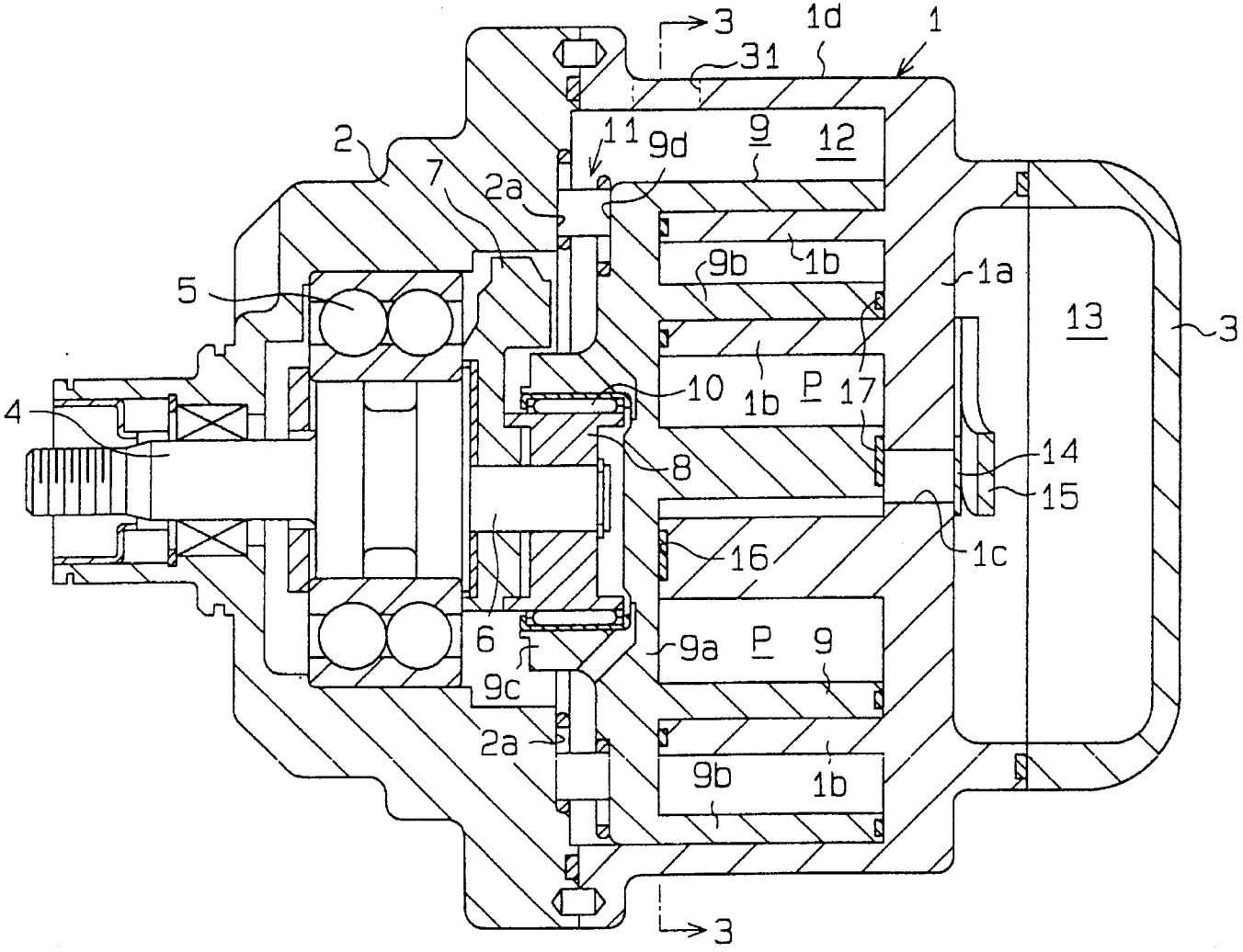
FIG. 2 is a vertical cross-sectional view of the compressor.

A scroll type compressor according to one embodiment of the present invention will now be described with reference to FIGS. 1 through 8. As shown in FIG. 2, a front housing 2 and a rear housing 3 are respectively secured to the front and rear ends of a fixed scroll 1 that forms a center housing 1*d*. The fixed scroll 1 has an end plate 1*a* and a spiral element 1*b* formed integrally with the front surface of the end plate 1*a*. A rotary shaft 4 is rotatably supported in the front housing 2 via a radial bearing 5, with an eccentric shaft 6 coupled to the rotary shaft 4.

Figure 3:
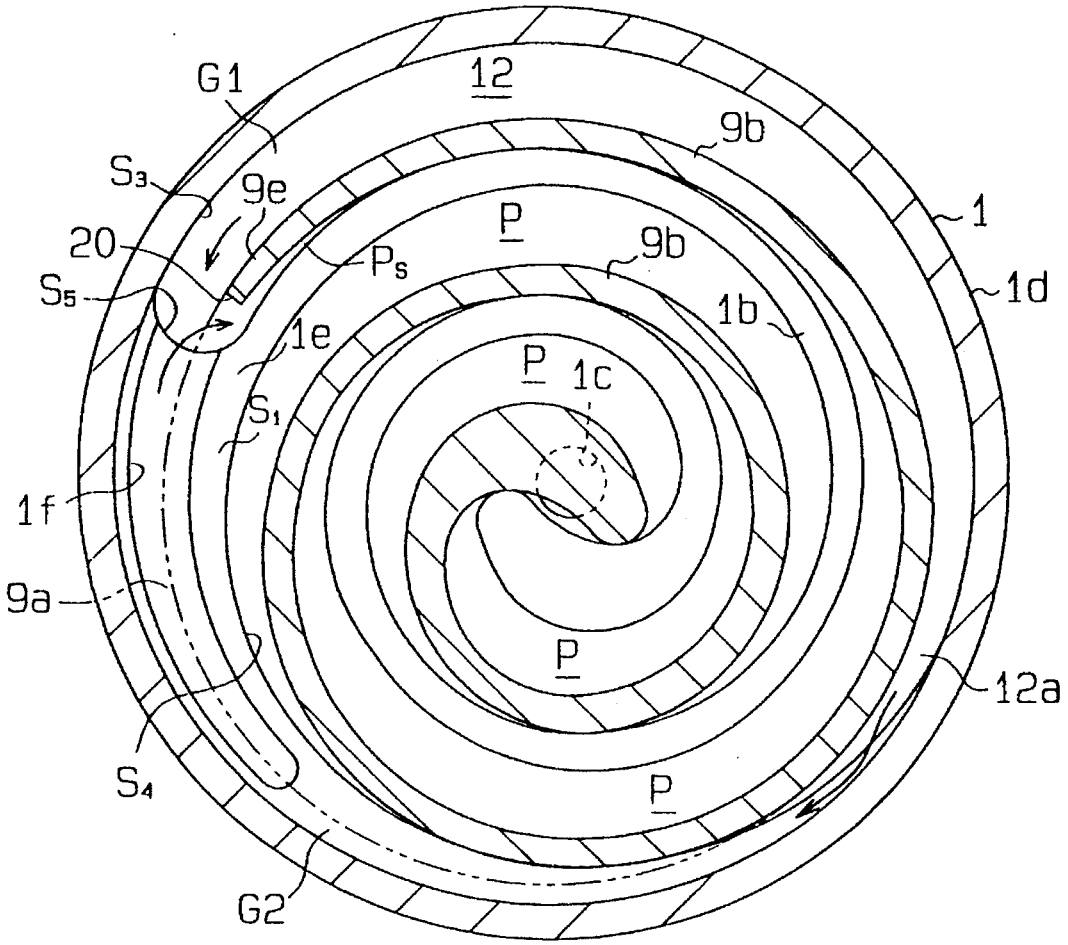
FIG. 3 is a cross-sectional view taken along the line 3—3 in FIG. 2.

A balance weight 7 is attached to the eccentric shaft 6, and a bushing 8 is rotatably supported on the eccentric shaft 6. A movable scroll 9 has an end plate 9*a* and a spiral element 9*b* formed integrally with the back surface of the end plate 9*a*. The end plate 9*a* has a cylindrical boss 9*c* formed integrally with the center portion of the front surface of the end plate 9*a*. The movable scroll 9 is rotatably supported on the outer peripheral surface of the bushing 8 at the boss 9*c* via a radial bearing 10. As shown in FIGS. 2 and 3, a plurality of fluid pockets P, sealed by the end plates 1*a* and 9*a* and by the spiral elements 1*b* and 9*b*, are formed between the spiral elements 1*b* and 9*b*.

As shown in FIG. 2, the front housing 2 is provided with a fixed pressure receiving wall 2*a* facing the movable scroll 9. A movable pressure receiving wall 9*d* is provided on the back of the movable scroll 9*a*. An anti-rotation device 11 of a known type, as described in, for example, Japanese Unexamined Patent Publication No. 2-308990, provided between both pressure receiving walls 2*a* and 9*d*, inhibits the rotation of the movable scroll 9 around the axis of the rotary shaft 4 and permits the orbital movement of the movable scroll 9 around the axis of the rotary shaft 4.

An arc shaped suction chamber 12 in the center housing 1, proximate to the outer tip portions of the spiral elements 1*b* and 9*b*, connects to the vehicle's air conditioning system via a suction port 31 and an external suction pipe line (not shown). A discharge port 1*c* is formed in the center portion of the fixed end plate 1*a*, and a discharge chamber 13 is formed in the rear housing 3. The discharge port 1*c* communicatively couples each fluid pocket P, which moves toward the central portion of the spiral elements 1*b* and 9*b*, with the discharge chamber 13. The discharge chamber 13 is connected to an external discharge pipe line via a discharge flange (not shown). A discharge valve 14 selectively opens and closes the discharge port 1*c* via a retainer 15, that regulates the amount by which the discharge valve 14 opens.

Refrigerant gas is initially supplied from the suction chamber 12 to an initial fluid pocket Ps, located between both scrolls 1 and 9, when the rotating rotary shaft 4 causes the eccentric shaft 6 to revolve and movable scroll 9 to orbit. Every time the movable scroll 9 orbits clockwise, the fluid pockets P, including the initial fluid pocket Ps, shift from the peripheral portions of the spiral elements 1*b* and 9*b*, to the center portions thereof. During this process, the fluid pockets P, Ps undergo a reduction in volume and compress the refrigerant gas, as shown in FIG. 3 and FIGS. 5 to 8. The compressed refrigerant gas pushes the discharge valve 14 open through the discharge port 1*c* shown in FIGS. 2 and 3, and enters the discharge chamber 13. When the refrigerant gas is compressed in each fluid pocket P, pressure in the thrust direction acts on the movable scroll 9, and is transmitted to the fixed pressure receiving wall 2*a* by the anti-rotation device 11.

A description will now be given of a passage which connects the suction chamber 12 to the initial fluid pocket Ps during the suction stroke of the refrigerant gas. As shown in FIGS. 1 and 3, the outer tip portion of the fixed spiral element 1*b* extends toward the inner peripheral surface, S3, of the center housing 1*d*. The extended portion is formed thicker than the other portion to constitute a connecting section 1*e* and is integrally coupled to the inner peripheral surface S3 of the center housing 1*d*. This connecting section 1*e* has a sealing surface S1. The proximal end of the connecting section 1*e* is thicker than the outer distal end of the fixed spiral element 1*b*, and the distal end of the connecting section 1*e* is thinner than the outer distal end of the fixed spiral element 1*b*. As is apparent from FIGS. 1 and 3, the connecting section 1*e* gradually becomes thinner in the counterclockwise direction along the inner peripheral surface of the housing 1*d*, so that the inner peripheral surface, S4, of the connecting section 1*e* smoothly approaches the inner peripheral surface S3 of the housing 1*d*. Furthermore, the inner surface S4 is formed contiguous with the inner surface of the fixed spiral element 1*b*.

The suction chamber 12, proximate to the connecting section 1*e*, has an inner wall S5 formed along an arc of a small radius. The rear surface, S2, of the movable end plate 9*a* as shown in FIG. 1, contacts the sealing surface S1 of the connecting section 1*e*, to seal the fluid pockets P. The connecting section 1*e* enhances the strength of the fixed spiral element 1*b*. The manufacture of the fixed spiral element 1*b*, according to this embodiment, can most easily be accomplished when the tapered connecting section 1*e* is formed at the outer end of the spiral element 1*b* rather than when the spiral element 1*b* has a nearly uniform thickness.

Figure 4:
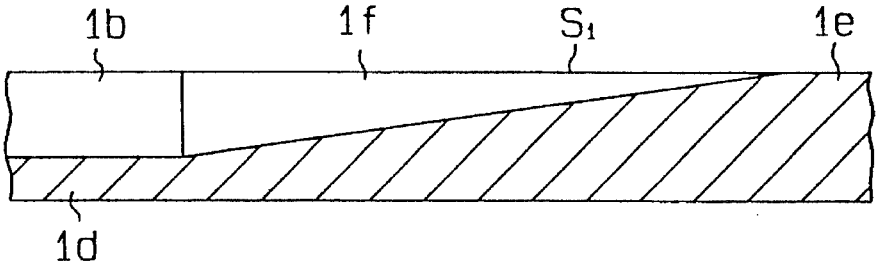
FIG. 4 is a fragmentary and enlarged cross-sectional view of a passage formed in the connecting section of the fixed scroll.

A communicating groove 1*f* is formed in the sealing surface S1 of the connecting section 1*e* as shown in FIGS. 1, 3 and 4. This communicating groove 1*f* extends from the inner wall S5 of the suction chamber 12, midway along the connecting section 1*e*, in an arc formed along the inner surface of the center housing 1*d*. At one end of the groove 1*f*, proximate to the suction chamber 12, the groove is open-ended. From its open end, groove 1*f* tapers in width and depth (i.e., it becomes more shallow) toward its closed end, proximate to the distal end of the connecting section 1*e*. The communicating groove 1*f* serves to connect the initial fluid pocket Ps to the suction chamber 12 during the suction stroke of the compressor.

FIGS. 2 and 3 illustrate the movable scroll 9 at the lowest position in the range of the orbital movement. At this time, the outer tip portion 9*e* of the movable spiral element 9*b* separates from the inner peripheral surface S3 of the housing 1*d* the distance of a first gap G1. The small initial fluid pocket Ps used at the beginning of the suction stroke is formed between the spiral elements 1*b* and 9*b*. The initial fluid pocket Ps is connected to the suction chamber 12 via an opening 20 between the outer tip portion 9*e* and the inner wall S5 of the suction chamber 12. A second gap G2 is formed between the movable end plate 9*a* and the inner peripheral surface S3 of the housing 1*d* in the vicinity of the communicating groove 1*f*. The second gap G2 communicatively couples both ends of the suction chamber 12 to the initial fluid pocket Ps. The initial fluid pocket Ps is therefore connected to the suction chamber 12 via the communicating groove 1*f* and the second gap G2. The suction operation of the initial compression cycle begins in this way with refrigerant gas being introduced to the initial fluid pocket Ps.

Figure 5:
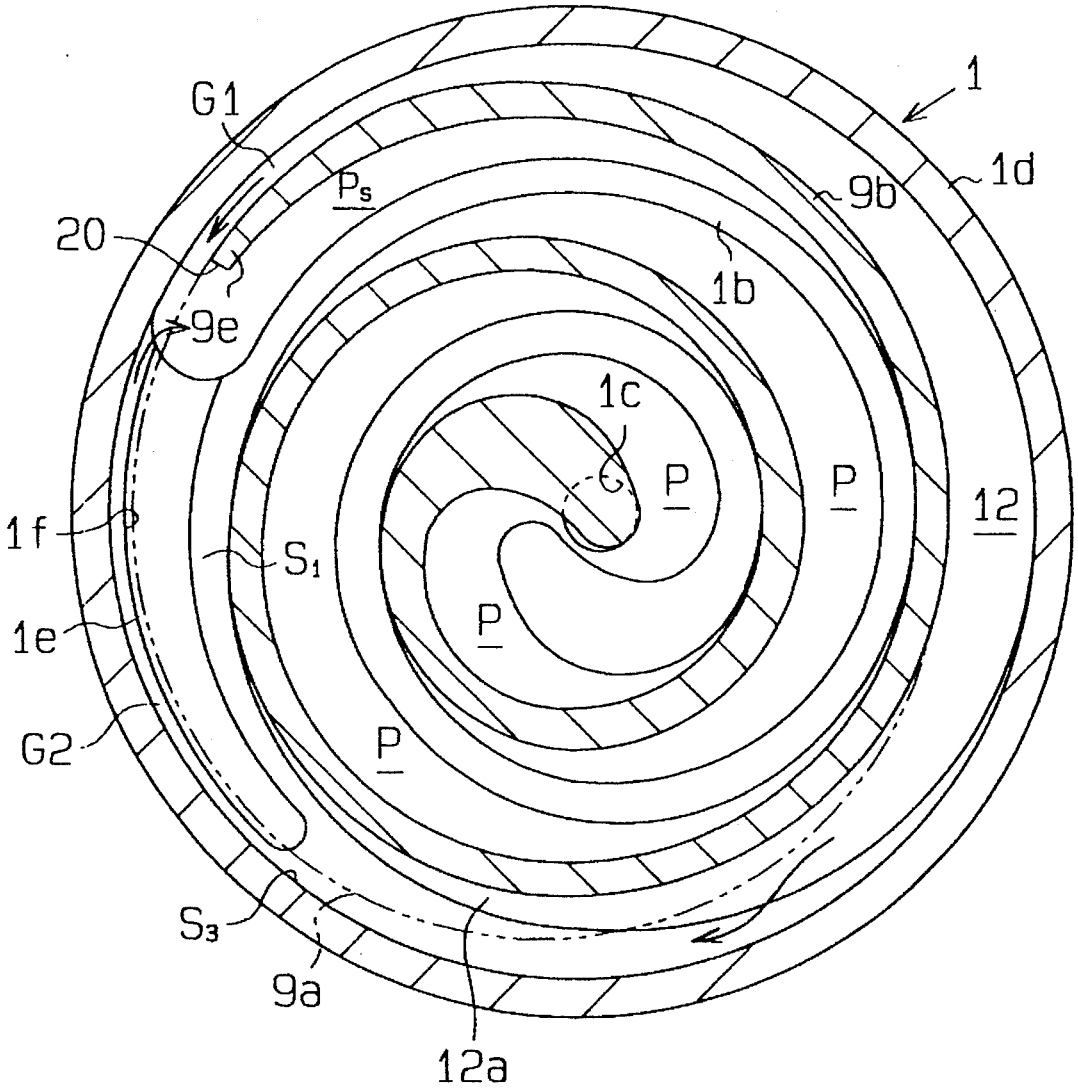
FIGS. 5 through 8 are cross-sectional views illustrating the clockwise orbital movement of the movable scroll at sequential predetermined angles from the position of the movable scroll shown in FIG. 3.

When the movable scroll 9 revolves 90 degrees clockwise from the position shown in FIG. 3 to the position shown in FIG. 5, the outer tip portion 9*e* of the movable end plate 9*b* approaches the inner peripheral surface S3 of the housing 1*d*. As a result, the first gap G1 becomes narrower. Since at this time the upper portion of the communicating groove 1*f* is not fully covered by the movable end plate 9*a*, refrigerant gas in the suction chamber 12 will flow into the initial fluid pocket Ps via the first gap G1, the opening 20, the second gap G2 and the communicating groove 1*f*.

Figure 6:
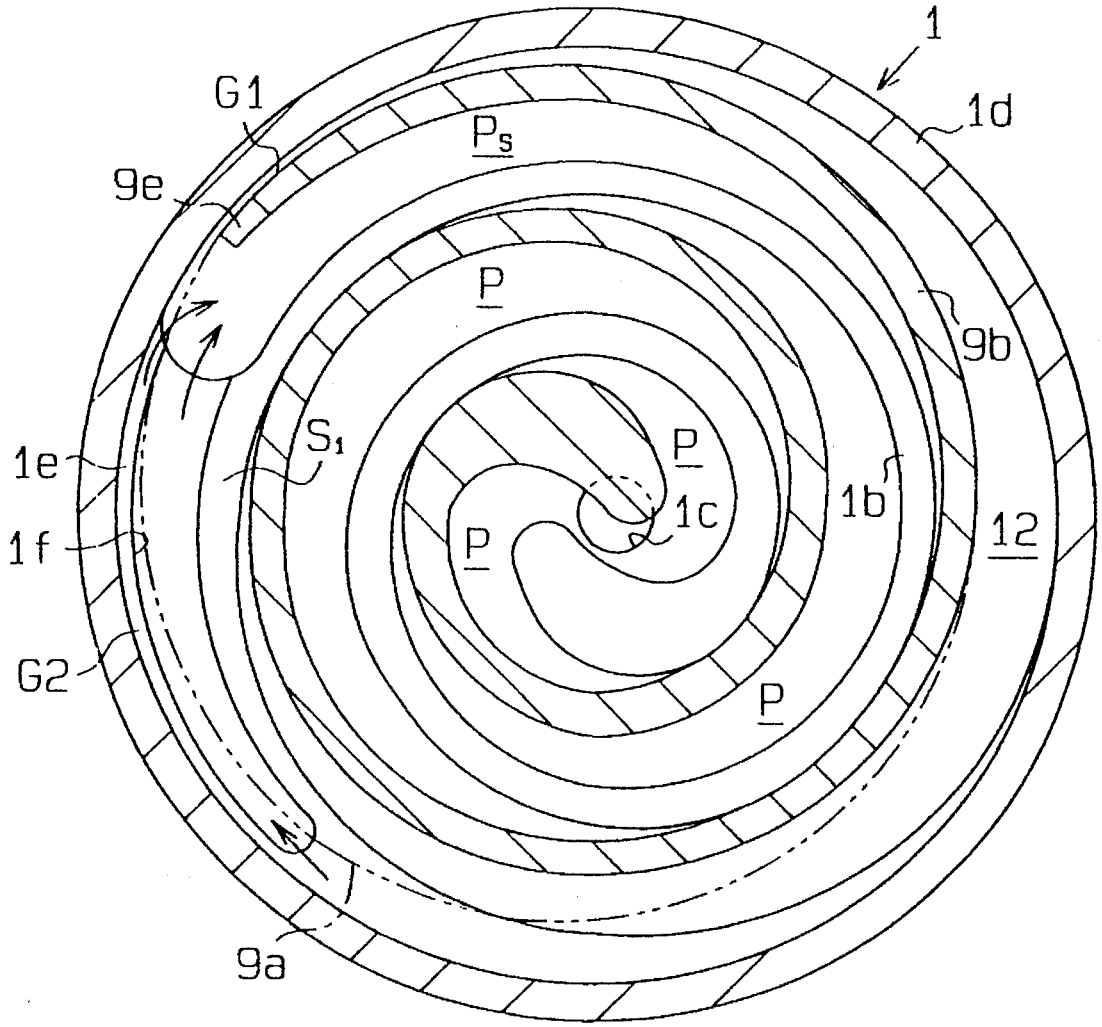

When the movable scroll 9 revolves 45 degrees from the position shown in FIG. 5 to that of the position shown in FIG. 6, the outer tip portion 9*e* of the movable end plate 9*b* comes closest to the inner peripheral surface S3 of the housing 1*d*, further narrowing the first gap G1. Even in this arrangement, however, the upper portion of communicating groove 1*f* is not fully covered or blocked by the movable end plate 9*a*. This allows refrigerant gas to flow into the initial fluid pocket Ps from the suction chamber 12 via the communicating groove 1*f*.

Figure 7:
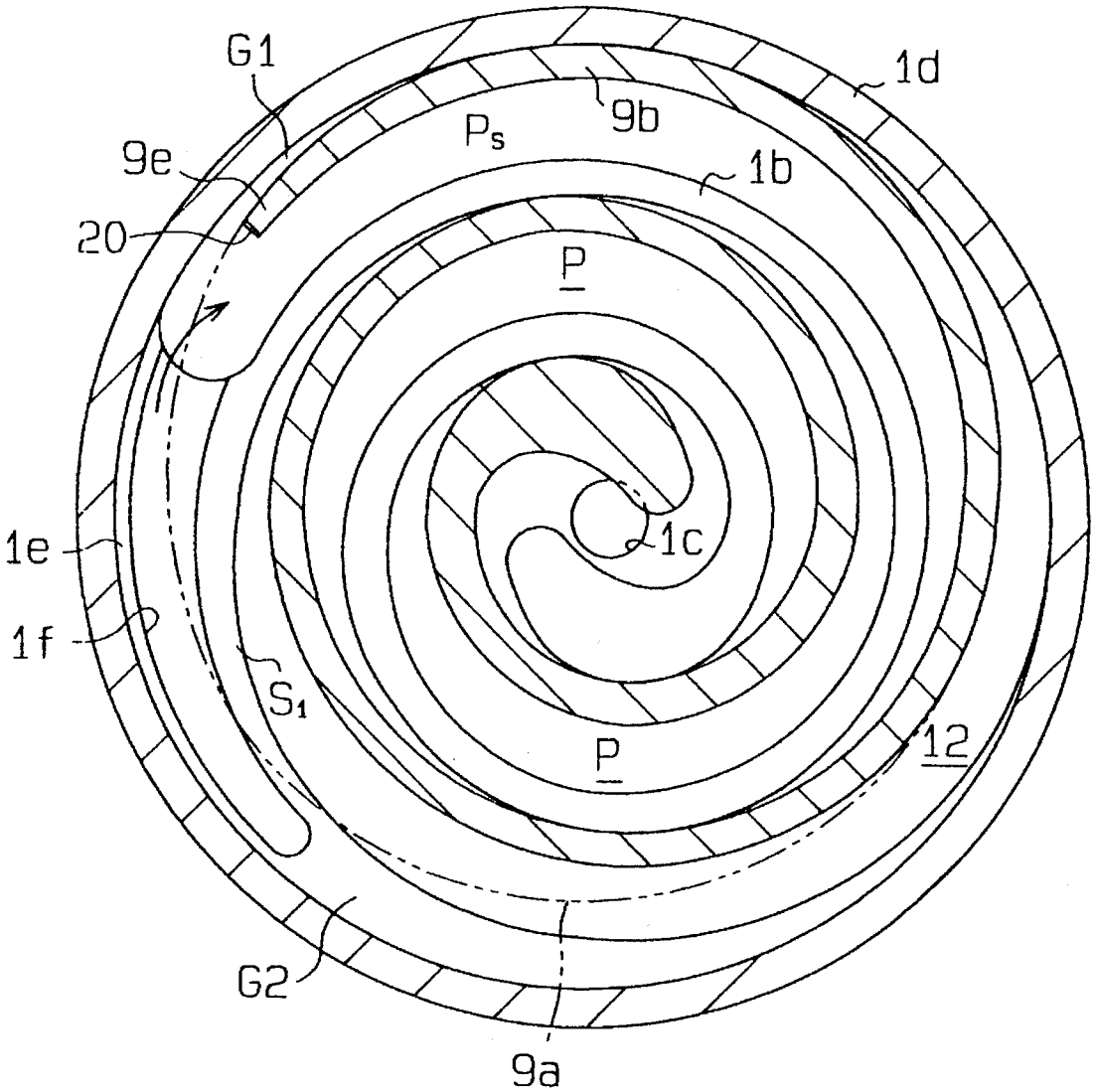

When the movable scroll 9 revolves 45 degrees from the position shown in FIG. 6 to the position shown in FIG. 7, the outer tip portion 9*e* of the movable end plate 9*b* comes in contact with the inner peripheral surface S3 of the center housing 1*d*, sealing the first gap G1 between the initial fluid pocket Ps and the suction chamber 12. In this situation, however, the second gap G2 is widened and the communicating groove 1*f* is not yet blocked by the movable end plate 9*a*. This allows for a smooth supply of refrigerant gas from the suction chamber 12 into the initial fluid pocket Ps via the communicating groove 1*f*.

Figure 8:
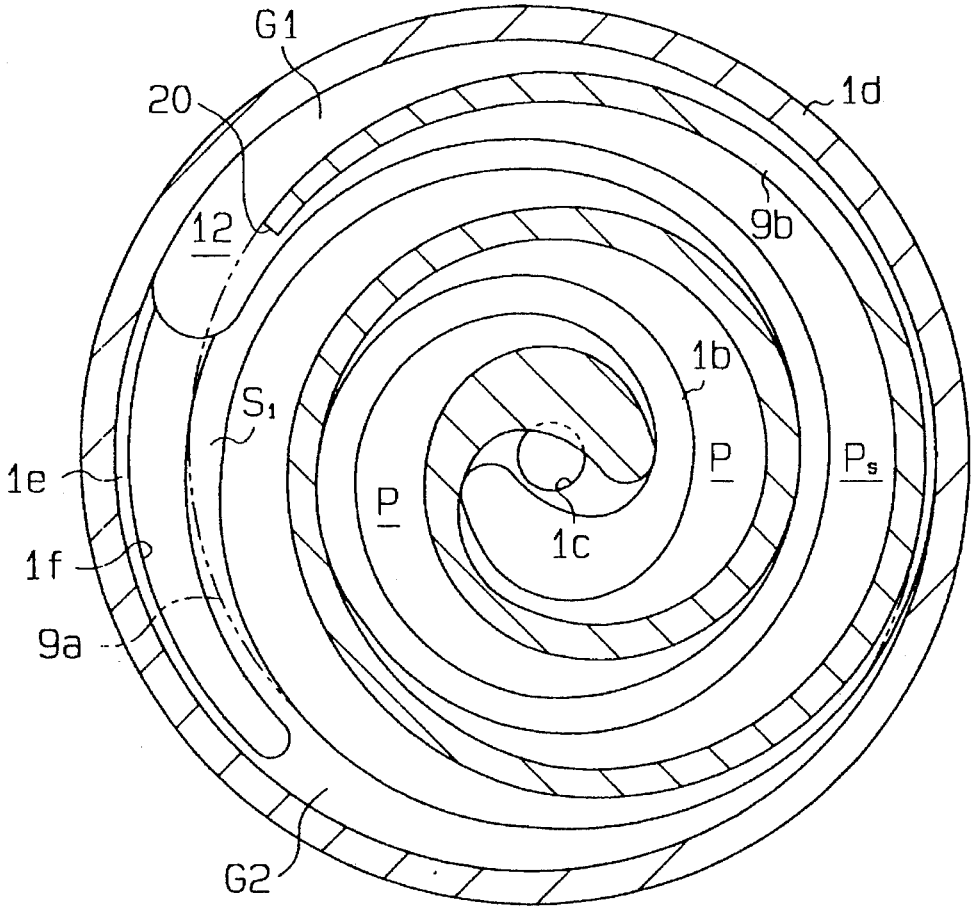

When the movable scroll 9 revolves an additional 90 degrees from the position shown in FIG. 7 to the position shown in FIG. 8, the suction stroke involving the initial fluid pocket Ps is completed and the compression stroke starts. When the movable scroll 9 revolves yet another 90 degrees from the position shown in FIG. 8, the movable scroll 9 returns to the position shown in FIG. 3.

In the suction stroke of the refrigerant gas, as discussed above, while the movable scroll 9 makes one orbital movement, the initial fluid pocket Ps is always kept connected to the suction chamber 12 by the communicating groove 1*f*. Thus, when the refrigerant gas flows into the initial fluid pocket Ps, no difference in pressure will exist between the initial fluid pocket Ps and the suction chamber 12. Unlike in the prior art, the present invention eliminates the rotation force generated by the introduction of refrigerant gas into the initial fluid pocket Ps. This enhances the smooth operation of the movable scroll 9, improves the compression efficiency of the compressor and reduces power loss.

The communicating groove 1*f* has such a tapered shape as to become shallower as the connecting section 1*e* becomes thinner, as shown in FIG. 4. Therefore, the communicating groove 1*f* effectively maintains the strength of the connecting section 1*e* in the circumferential direction.

The present invention is not limited to the above-described embodiment, but may be embodied in the following manners.

Figure 9:
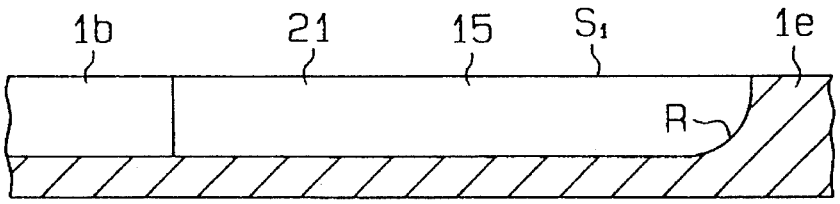
FIG. 9 is a partial and enlarged cross-sectional view showing another example of the passage shown in FIG. 4.

(1) As shown in FIG. 9, the communicating groove, 21, may be formed having a constant depth, with its inner end face formed along an arc R.

Figure 10:
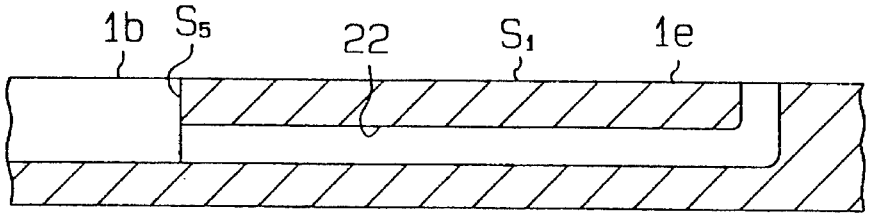
FIG. 10 is a partial and enlarged cross-sectional view showing a further example of the passage shown in FIG. 4.

(2) A communicating groove 22 may be formed inside the connecting section 1*e*, with its one end opened to the inner wall S5 and the other end opened to the sealed surface S1, as shown in FIG. 10.

Figure 11:
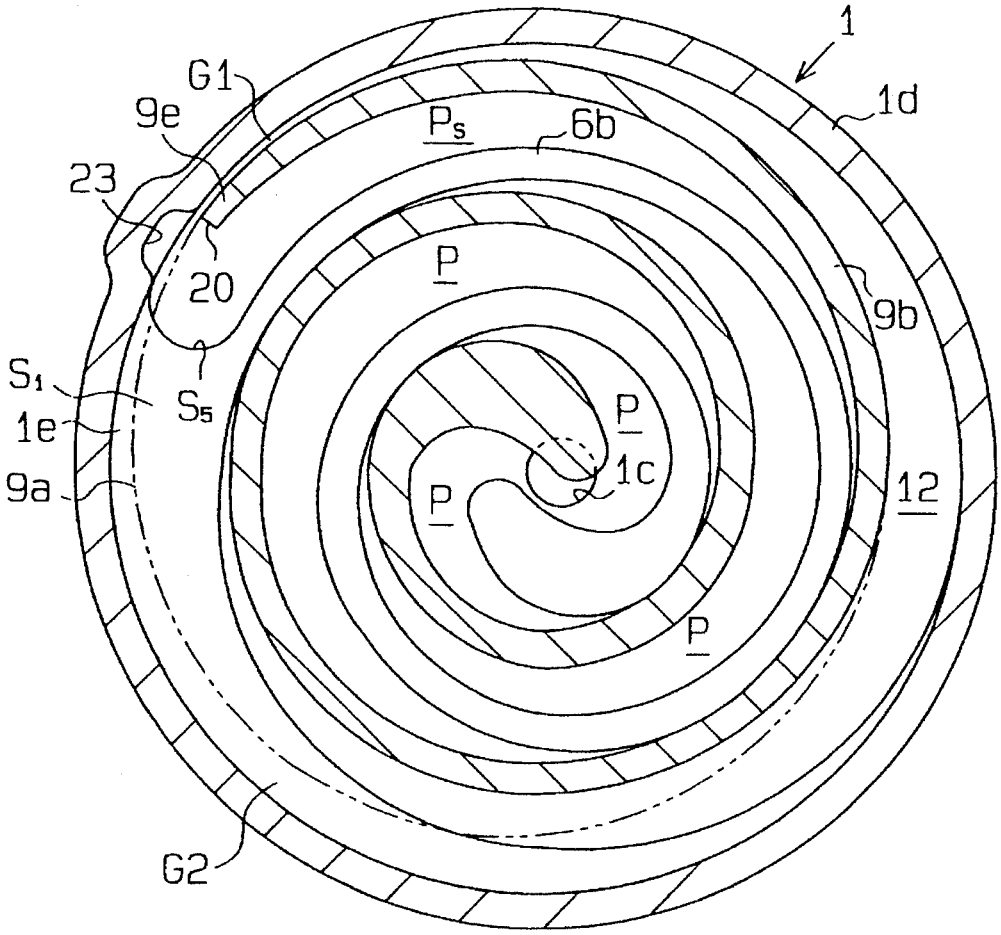
FIG. 11 is a cross-sectional view of a compressor according to a further embodiment of this invention.

(3) As shown in FIG. 11, a portion of the center housing 1*d* may extend outward with a recess 23 formed inside that center housing portion. The recess 23 is formed close to the outer tip portion 9*e* of the movable spiral element 9*b*, so that when the outer tip portion 9*e* comes closest to the inner peripheral surface of the center housing 1*d*, the initial fluid pocket Ps is in communication with the suction chamber 12, as illustrated in FIG. 11. In this case, the recess 23 is formed at the same time the housing 1*d* is formed, making for an easy and less costly manufacturing process. The recess 23 may be formed by a machining operation after the housing 1*d* is formed.

Figure 12:
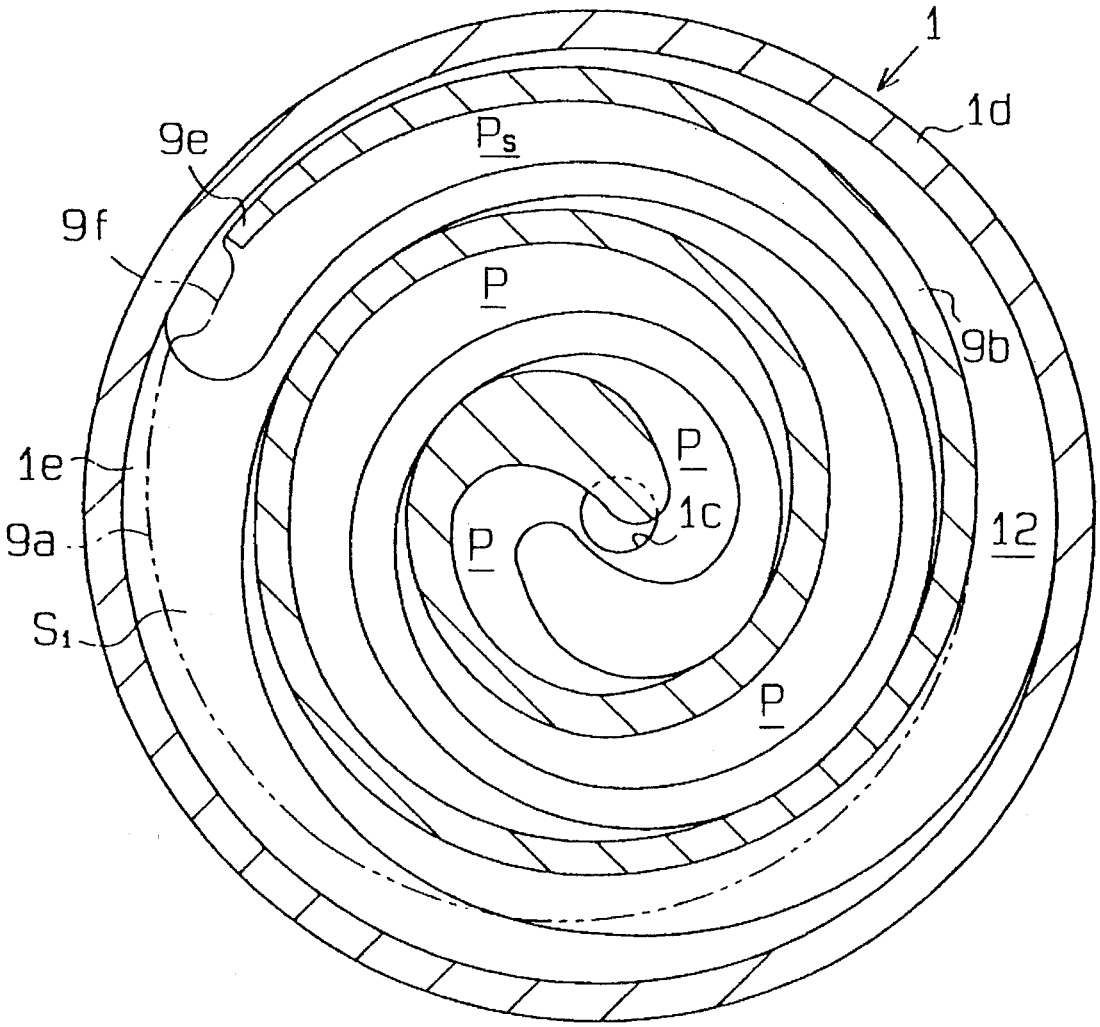
FIG. 12 is a cross-sectional view of a compressor according to yet another embodiment of this invention.
Figure 13:
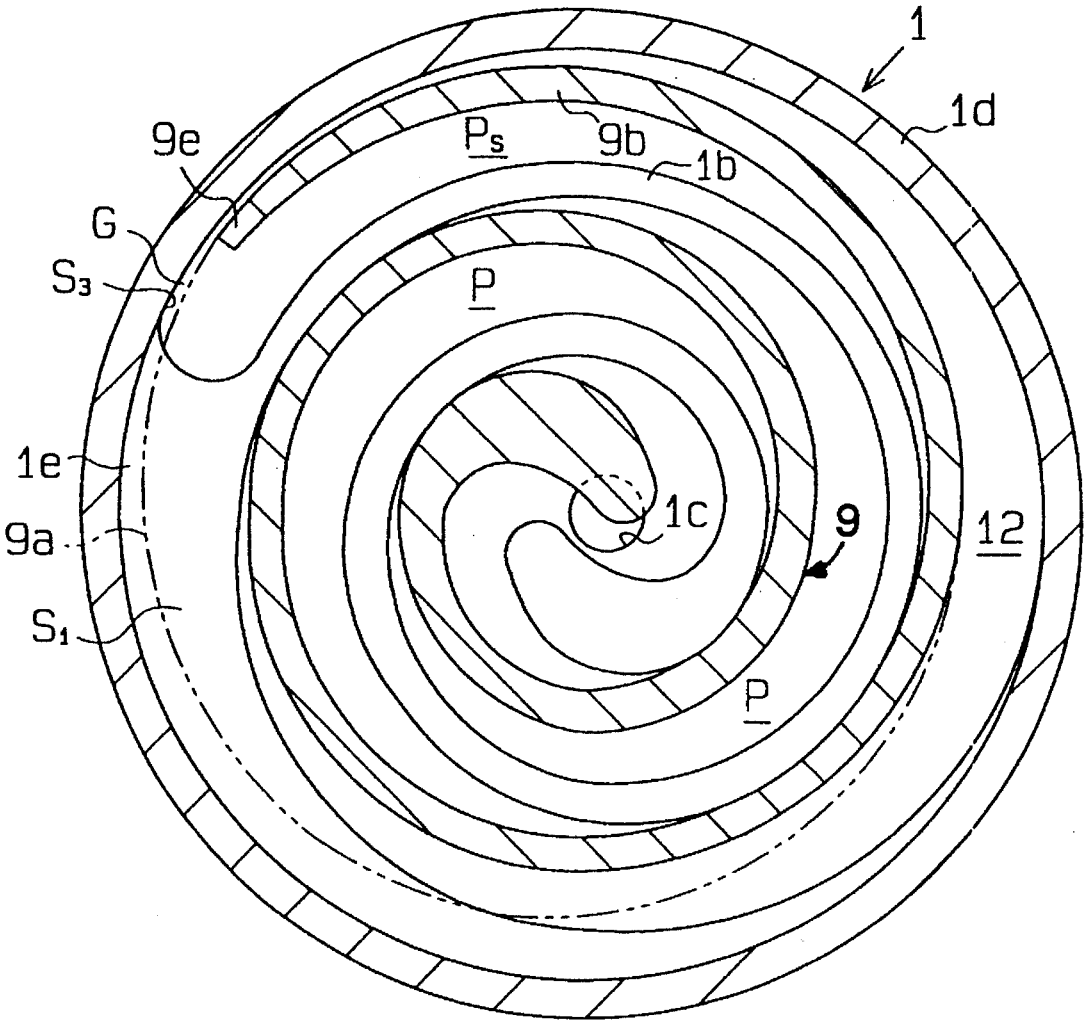
Fig. 13 (Prior Art)
FIG. 13 is a cross-sectional view of a conventional compressor.

(4) A recess 9*f* may be formed by machining away the outer peripheral edge of the movable end plate 9*a* as shown in FIG. 12. This recess 9*f* is formed close to the outer tip portion 9*e* of the movable spiral element 9*b* so that when the outer tip portion 9*e* comes closest to the inner peripheral surface of the center housing 1*d*, the initial fluid pocket Ps communicates with the suction chamber 12.

In this case, the communicating groove 1*f* need not be formed in the connecting section 1*e*, and the communication between the initial fluid pocket Ps and the suction chamber 12 can be secured by the simple work of machining away a part of the end plate 9*a*. Further, the outer size of the housing 1*d* need not be partially enlarged like that of the housing 1*d* as shown in the modification in FIG. 11.

Figure 14:
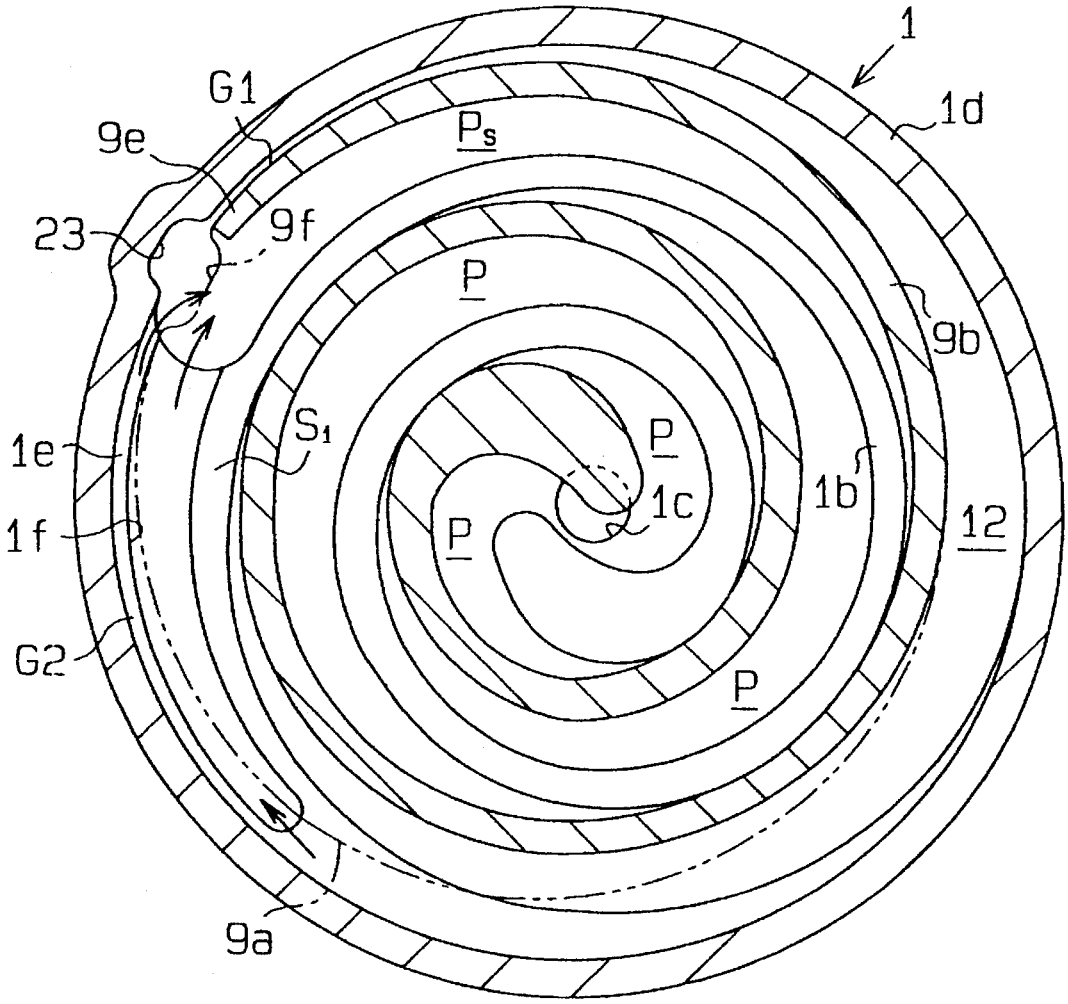
FIG. 14 is a cross-sectional view of a compressor according to a modified embodiment of this invention.

(5) The aforementioned communicating grooves 1*f*, 21 and 22 and the recesses 23 and 9*f* may be used in any combination. FIG. 14 illustrates a modified compressor utilizing the groove 1*f* shown in FIG. 3, the recess 23 shown in FIG. 11 and the recess 9*f* shown in FIG. 12.

Therefore, the present examples and embodiments are to be considered as illustrative and not restrictive and the invention is not to be limited to the details given herein, but may be modified within the scope of the appended claims.

What is claimed is:

1. A scroll type compressor including a fixed scroll provided in a housing having an inner wall, a connecting section connecting said fixed scroll to said housing, and a movable scroll eccentrically connected to a rotary shaft in the housing for performing an orbital movement without rotating about an axis thereof and opposed to said fixed scroll to define a plurality of pockets therebetween, the volume of each of said pockets being reduced in accordance with the orbital movement of said moveable scroll to compress refrigerant gas led into one of said pockets:

a suction chamber defined between said moveable scroll and said housing;

said fixed scroll having a fixed end plate and a fixed spiral element, said fixed spiral element having an inner end located substantially at a center of said housing and an outer end located adjacent to said inner wall of said housing;

said moveable scroll having a moveable end plate and a moveable spiral element;

said connecting section extending towards said inner wall of the housing from said outer end of said fixed spiral element and having an initial end which is thicker than said outer end of said fixed spiral element and a terminal end which is thinner than said outer end of said fixed spiral element, said connecting section having gradually decreasing thickness along the inner wall of the housing; and a passage provided in at least one of said housing, said connecting section and said moveable scroll, said passage guiding the refrigerant gas from said suction chamber to said one pocket for reducing any pressure difference between said suction chamber and the pocket when the refrigerant gas is introduced into the pocket, said passage including a first recess formed in the connecting section, said first recess having a depth decreasing substantially in proportion to the thickness of the connecting section for ensuring the strength of the connecting section.

2. A compressor according to claim 1, wherein:

said moveable end plate is slidable on the connecting section; and said passage is in said connecting section and is coverable by the moveable end plate;

whereby said moveable end plate slides on the connecting section to variably determine the extent of covering of the passage.

3. A compressor according to claim 1, wherein said passage includes another recess formed in the movable end plate, said another recess opposing the movable spiral element when the refrigerant gas is introduced into the pocket.

4. A compressor according to claim 1, wherein said passage includes a second recess formed in the inner wall of the housing adjacent to the initial end of the connecting section.

5. A compressor according to claim 4 further comprising an expanded section provided on the housing, said expanded section having the second recess therein.

6. A scroll type compressor including a fixed scroll provided in a housing having an inner wall and having a connecting section connecting the fixed scroll to the housing, and a movable scroll eccentrically connected to a rotary shaft in the housing for performing an orbital movement without rotating about an axis thereof and opposed to the fixed scroll to define a plurality of pockets therebetween, wherein the volume of each pocket is reduced in accordance with the orbital movement of the movable scroll to compress refrigerant gas led into the specified one of said pockets;

said fixed scroll having a fixed end plate and a fixed spiral element;

said movable scroll having a movable end plate and a movable spiral element;

said fixed spiral element having an inner end located at substantially a center of the housing and an outer end located in the vicinity of the inner wall of the housing;

said connecting section extending toward the inner wall of the housing from the outer end of the fixed spiral element and having an initial end thicker than the outer end of the fixed spiral element and a terminal end thinner than the outer end of the fixed spiral element, said connecting section having gradually decreasing thickness along the inner wall of the housing;

a suction chamber defined between the movable scroll and the inner wall of the housing; and a passage including a first recess provided in the connecting section, said first recess having a depth decreasing substantially in proportion to the thickness of the connecting section for ensuring the strength of the connecting section, and said first recess guiding the refrigerant gas from the suction chamber into said specified pocket for reducing any pressure difference between the suction chamber and the pocket when the refrigerant gas is introduced into the pocket.

7. A compressor according to claim 6 wherein:

said movable end plate is slidable on the connecting section; and said passage is coverable by the movable end plate;

whereby said movable end plate slides on the connecting section to variably determine the extent of covering of the passage.

8. A compressor according to claim 6, wherein said passage includes a second recess provided in the inner wall of the housing adjacent to the initial end of the connecting section.

9. A compressor according to claim 8 further comprising an expanded section provided on the housing, said expanded section having the second recess therein.

10. A compressor according to claim 8, wherein said passage includes a third recess formed in the movable end plate, said third recess opposing the movable spiral element when the refrigerant gas is introduced into the pocket.

* * * * *